US005411150A

United States Patent [19]

Sigurdsson

[11] Patent Number: 5,411,150

[45] Date of Patent: May 2, 1995

[54] CULLING DEVICE FOR VACUUM CLEANERS AND OTHER EQUIPMENT

[76] Inventor: Steinn Sigurdsson, Steinasel 1, 109 Reykjavik, Iceland

[21] Appl. No.: 967,506

[22] Filed: Oct. 28, 1992

[30] Foreign Application Priority Data

Oct. 28, 1991 [IS] Iceland ..... 3776

[51] Int. Cl.[6] ..... B07B 9/00; A47L 9/00

[52] U.S. Cl. ..... 209/235; 209/22; 209/24; 209/392; 15/339; 15/350

[58] Field of Search ..... 209/235, 391, 392, 397, 209/400, 21, 22, 23, 24, 25; 15/339, 344, 347, 350; 55/309, 422, 527

[56] References Cited

U.S. PATENT DOCUMENTS

| | | | |
|---|---|---|---|
| 954,164 | 4/1910 | Broekema . | |
| 2,032,579 | 3/1936 | Johnson | 209/235 X |
| 2,467,652 | 4/1949 | Beede | 15/339 X |
| 3,141,844 | 7/1964 | Brauchla et al. | 209/392 X |
| 3,267,650 | 8/1966 | Lundin | 15/339 X |
| 4,195,383 | 4/1980 | Leinfelt | 15/339 |
| 4,825,502 | 5/1989 | Armstrong et al. | 15/350 X |
| 4,833,753 | 5/1989 | Muller | 15/339 |

*Primary Examiner*—Cheryl L. Gastineau
*Assistant Examiner*—Tuan N. Nguyen
*Attorney, Agent, or Firm*—Antonelli, Terry, Stout & Kraus

[57] ABSTRACT

Culling device for vacuum cleaners and other equipment which is made either as uni-functional (1) or two-functional (16), a part of which enclosure (6) is most frequently made of transparent materials, the device itself being made as tube, handle, part of handle or a specially constructed device which is inserted into the conveying tunnel of a vacuum cleaner (suction pipes), or similar devices. Inside the culling device there are waveformed paralell teeth (4) on a moveable axle (9), so-called culling comb (2), which by an external actuating mechanism (13, 24, 14, 5) is either adjusted so that:

a) it rises diagonally into the air path and arrests articles which are carried into the culling device, while they are inspected and, as the case may be, removed (uni-functional culling device), or sucked or otherwise collected into a special collecting compartment (two-functional culling device), or b) it lies down and allows passage for the articles into the vacuum cleaner's accumulation case (its dustbag).

10 Claims, 6 Drawing Sheets

CULLING DEVICE FOR VACUUM CLEANERS AND OTHER EQUIPMENT

TECHNICAL FIELD OF THE INVENTION

The culling device of the invention, of which some models are named Visio-Vac, is either made as uni-functional or two-functional. A part the device enclosure is most frequently made of transparent material, the device itself being made as a tube, handle, part of handle or a specially constructed device which is inserted into the conveying tunnel of vacuum cleaners (suction pipes), or similar devices. Inside the culling device's enclosure there are waveformed parallel teeth on a moveable axle, so-called culling comb, which by means of an external actuating mechanism is either adjusted so that:

a) it rises diagonally into the air path and arrests articles which are carried into the culling device while they are inspected and, as the case may be, removed (uni-functional culling device), or sucked or otherwise moved into a special collecting compartment (two-functional culling device), or b) it lies down and allows passage for the articles into the vacuum cleaner's accumulation case (its dustbag).

BACKGROUND OF THE INVENTION

Like innumerable tasks in which the human race has been engaged, the concept of vacuum cleaning is based on the laws of the Prime Elements. The powers of weather and wind have taught mankind that powerful windblast can move things, both small and large, and this has been applied by man to give power to machines and as means of transportation. Devices of various kinds for moving things or collecting them by means of suction are based on the same laws, including the vacuum cleaner, in which suction (the air flow) is man-made by motor power.

The vacuum cleaner as we know it is an offspring of the age of electricity. As such it does not have a long history and it has therefore been developed from the same basic ideas in similar ways in all continents, namely to gather free matter into an accumulation case, such as dust into a vacuum cleaner's dustbag (filter bag), by means of air flow (suction power) generated by an electric motor.

The conventional vacuum cleaner, like many other suction devices, is based on three major components, which are:

a) a coveying tunnel (suction pipe) for the air flow (the suction power), b) an electric motor with fans which propels the air flow, and c) an accumulation case (a dustbag) for matter collected by the vacuum cleaner.

The vacuum cleaner is operated by carrying the suction pipe's (conveying tunnel's) orifice up to the matter to be recovered, so as to enable the suction power of the air flow to move it and thus convey it by drift through the conveying tunnel into the vacuum cleaner's accumulation case (the dust), the recovered matter is arrested there on the inside of its filtering wall, where it accumulates as the air flow goes on and thrusts through the filtering wall.

Vacuum cleaners are most frequently designed in one of two ways, the first design is a combined design where the conveying tunnel is extremely short and integral with the apparatus in such way that its orifice is a fixed part of it. These vacuum cleaners suffer the disadvantage that their bulky machinery is closely connected to the orifice, which makes them cumbersome in use, and limits their passage into corners or narrow places, such as under furniture.

The other design is designed in units where the conveying tube is a combination of suitably long metal pipes and flexible air hoses (suction tubes), of which one end is connected to the machinery, and the other end (the orifice of the conveying tube) may be moved over a circular surface, without moving the machinery, with a radius nearly equal to the length of the metal pipes and the air tubes added together (the conveying tunnel). The orifice takes shape from separately designed accessories, which can be fixed to it and are interchangeable, so that its size, shape and function differs.

Originally the accumulation case was most frequently made of durable material, such as laminated textile bags which were regularly emptied, but in later years various types of disposable paper bags have been almost exclusively used, which are thrown away along with the dust and replaced by new bags. These bags have some disadvantages, one of which is that when comparatively heavy and sharp articles are slung forcefully into newly installed bags to which dust has not yet assembled on the inside as a protecting layer, they may tear holes in them through which dust and small debris may diffuse into the air. Everything which the vacuum cleaner captures goes into these bags, whether worthless or useable or even valuable things, which somehow have come across the path of the vacuum cleaner.

When vacuum cleaning, one hears now and then a click and a rattle from the vacuum cleaner or the suction pipes, when rigid articles are sucked into the equipment, such as buttons, small articles from household appliances (screws etc.), coins, rings and jewelry or fragments of jewelry, even gems, and so on. Each time this happens it causes one to worry and question what may have caused this. When suspicion arises that something of value has been sucked into the vacuum cleaner, the usual resort is to tear open the dustbag and rummage in the dust in order to ascertain whether it may be found there. This is both a dirty job and a tardy one, and most homes lack the facilities for undertaking such search with its offending dust pollution and uncleanliness, apart from the fact that the article in question may not at all be found when the bag contains some quantity of dust. Here one can mention that destitute people who seek to obtain their sustenance on the scrap-heaps of large cities, take special interest in dust bags from vacuum cleaners, in order to search them through for valuables.

It is therefore clear that there is much to gain by making it possible to inspect simultaneously the articles which are carried into the vacuum cleaner, and to ascertain without difficulty whether they include something which should not be thrown away, and if so, recover it, before it enters into the accumulating case. This is the object of the present invention.

SUMMARY OF THE INVENTION

The invention is named culling device. Its enclosure is most frequently made of transparent material and is installed in a vacuum cleaner's conveying tunnel. In vacuum cleaners designed in separate units the culling device is best installed at the end of the flexible hose (hose and tube junction), at the point where the tube is held when the apparatus is used. When thus installed, a part of the culling device's enclosure is used as a handle with a curve of about 30°, taking the place of the older types of handle, and various controls previously often placed on the handle may readily be accommodated on the culling device, such as electric switches, air flow regulators etc. Inside the culling device there is a special form of grating, the so-called culling comb, which either arrests the movement of objects or allows them to continue on their way into the vacuum cleaner's accumulation case.

Culling devices are either produced as:

a) Culling device I: separate units and in variable sizes to be installed between the junctions of the tubes and hoses of vacuum cleaners, simultaneously serving as a handle or part of a handle, or b) Culling device II: special equipment installed elsewhere in a vacuum cleaner's conveying tunnels, or as larger and more sophisticated models operated by automatic control, to be used as selecting or safety devices in industrial conveying tunnels or conveyance equipment.

The duct inside the enclosure of the culling devices is of nearly the same dimension as in adjacent tubes and hoses, and therefore offers little or no resistance to the passing flow, but its shape is different in such way that at the rear of the enclosure there is a low-lying transverse wall. Along the top of the transverse wall lies a moveable axle to which waveformed parallel teeth are fixed, together constituting the culling comb. The axle's ends extend on both sides out to and usually out through the culling device's walls. Outside the culling device a special actuating mechanism is fixed to the axle's ends, which can turn the axle 45° and thus raise the culling comb or lay it down.

The culling comb, in the disclosed embodiments which is a moveable axle with waveformed parallel teeth, is the functional part of the invention. The length of the teeth is adapted to the wall's lining of the duct, inside the culling device's enclosure, in such way that each tooth extends all the way across the duct, when the culling comb is raised, so as to arrest the movement of articles. The teeth are made crooked, i.e. waveformed, in order to give them increased efficiency, similar to which a mesh would have if it were used to select out or arrest matter in the conveying tunnel. This waveformed configuration, mostly long, slender articles from passing between the teeth, as compared to a relatively easy passage for such articles between straight teeth. Therefore, due to the waveform, the teeth have almost the same ability as a mesh to filter out matter with great accuracy, and in addition to that they are self cleaning, since they have no crossbars as a mesh, and therefore all matter glides freely along the teeth and is easily sucked away from them, when they are laid down.

The teeth are waveformed transversely, i.e. as they extend from the axle they swing sideways alternatively to each side, up to 45°, forming smooth waves in step with the waves formed in the same way by the adjacent tooth or teeth. This harmonious waveform extends all the way across the comb.

The superior ability gained by using a culling comb with waveformed parallel teeth in the culling device, instead of e.g. a mesh, became apparent in numerous experiments with various comb types, which showed that all kinds of matter, such as hair, pieces of string and elongated debris which accumulated on the combs did not stick to the teeth and was easily removed by laying down the culling comb with the actuating mechanism and letting the air flow suck the matter away. Therefore the teeth must have a smooth and faultless surface in order to make them as slippery as possible. For the same reason the teeth must be made of strong and hard material so they will not become notched or damaged from being hit by sharp articles which are carried by the air flow into the culling device to clash against the teeth, because matter could then start to stick fast to them in notches or scars.

By means of the actuating mechanism, the culling-comb is either raised diagonally across the duct inside its enclosure so that articles which are carried into the device come against the teeth, which arrest them, or laid down to make the teeth level with the air flow and pointing in the same direction. This allows articles which the teeth have already arrested or are being carried through the conveying tunnel into the culling device, to be sucked unobstructed into the vacuum cleaner's accumulation case. The same applies for other matter which has accumulated on the teeth, i.e. the self-cleaning process.

The actuating mechanism can be activated in various ways, such as by hand, by power equipment which is selfregulating or otherwise automatically controlled, or even operated by electronic devices, e.t.c. More complex power and regulating equipment is needed for larger and more sophisticated culling devices, especially to two-functional types of the Culling device II versions, which are ment for large pre-installed systems of conveying tunnels, used, e.g., in various industries. In these cases variants of culling devices can be used in all sorts of conveying tunnels or conveyance equipment, such as for air, liquids, powder materials, etc.

The culling device is, as already indicated, designed in two basic versions which are:

a) Uni-functional, in which articles are arrested by the culling-comb, as they are carried into the culling device and kept there while they are inspected through the transparent enclosure of the culling device and a decision made whether they should be removed or allowed to pass through by laying down the culling comb. If articles are to be removed from the culling device one opens it by disconnecting it from the suction pipe at the connection closer to the suction pipe's orifice.

b) Two-functional, which has the ability, in addition to that of a uni-functional culling device, to collect the articles into a special collecting compartment, in which case they are either:

ba) sucked or driven into it by means of a flap which by special operation obstructs the ordinary duct inside the culling device and directs the flow through the collecting compartment, or bb) by other means moved into it (special versions of Culling devices II).

By using a two-functional culling device one can therefore either reserve the articles in a special collecting compartment, or let them pass the culling comb. The articles are removed from the collecting compartment e.g. through a special hatch in the compartment's bottom. It is therefore possible by means of the two-functional culling devices to collect all larger articles before they are slung into the vacuum cleaner's dustbag, and thus completely prevent them from tearing holes in it.

DETAILED DESCRIPTION OF THE DISCLOSED EMBODIMENTS

Figure 1:
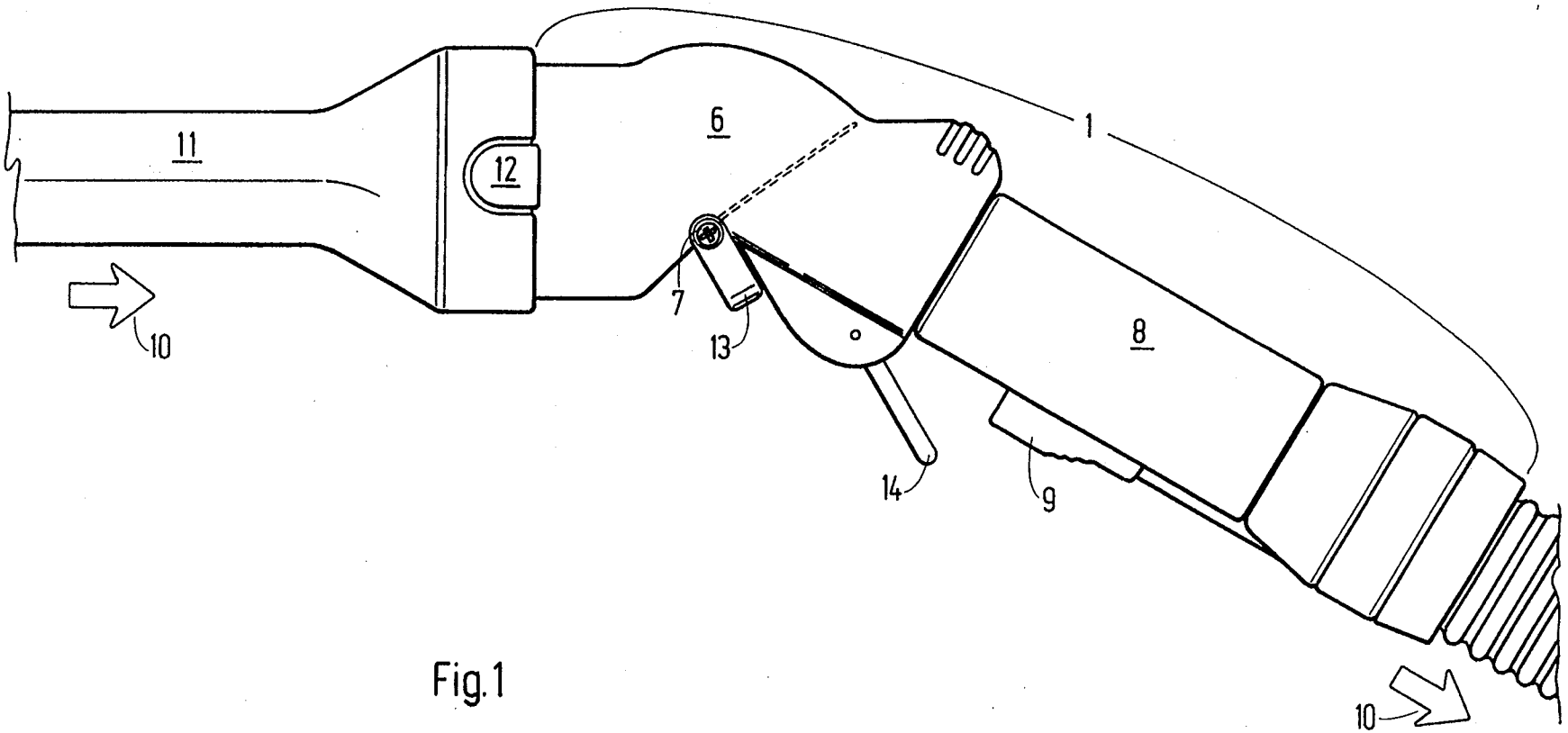
FIG. 1 is a side view of a uni-functional culling device according to one embodiment of the invention.

The uni-functional culling device (1) of FIG. 1 is a side view showing the external appearance of the device. The air flow indicated by an arrow (10) enters the transparent enclosure of the culling device (6) which is connected to a connecting device (11) which combines it to the suction pipes, and is fixed with a special snap-lock (12). A curved clasp (13), which is a part of the culling comb's (2) actuating mechanism, is fixed on both sides to the culling comb's axle ends (7), where they extend out through the walls of the culling device's enclosure. The actuating mechanism's control lever (14) extends, like a trigger on a gun, diagonally from under the transparent part of the culling device's enclosure, towards its handle (8). Beneath the handle is a slip-lock (9) which can be pushed forward to fix the control lever in an upright position, which thus holds the culling comb, inside the culling device, in a steady down position.

Figure 2:
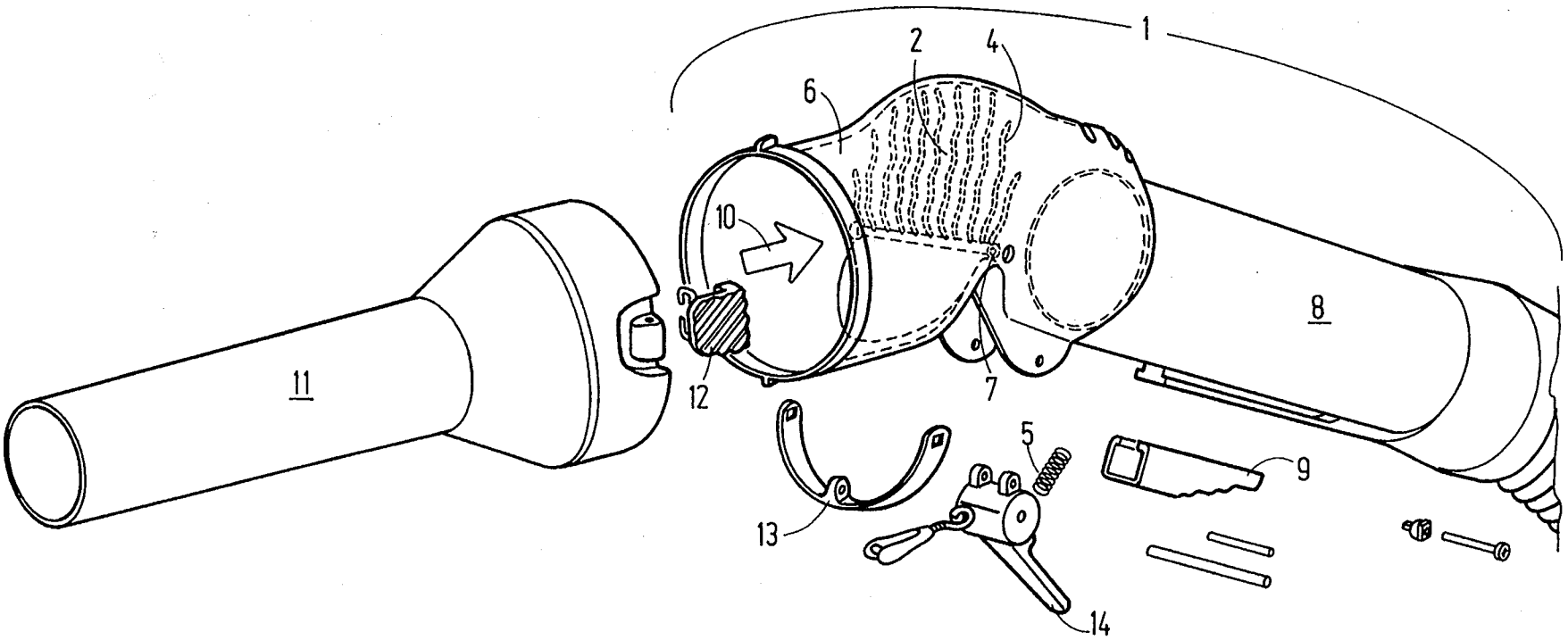
FIG. 2 is a side view of the culling device of FIG. 1, seen in perspective. Through the transparent enclosure of the culling device the culling comb is seen in a raised position. The culling comb's actuating mechanism is illustrated in a disassembled state.

The uni-functional culling device (1) is seen in perspective in FIG. 2. Through the transparent enclosure of the culling device (6) the culling comb (2) is seen in a raised position, thus arresting articles which are carried by the air flow (10) into the culling device. The actuating mechanism is illustrated in a disassembled state, and includes a curved clasp (13) which is to be fixed on both sides to the axle's ends (7), the control lever (14), adjustable connection (24) and the slip-lock (9). A helical spring (5) maintains the control lever in an extended position when it is not pulled or locked, thus holding the culling comb (2) in a raised position. Through the transparent part of the culling device (6) the culling comb's waveformed parallel teeth (4) are seen in raised position. The connecting device (11) which combines the culling device to the suction pipes, a special snap-lock (12) which fixes them together, and the culling device's handle (8), are also displayed.

Figure 3:
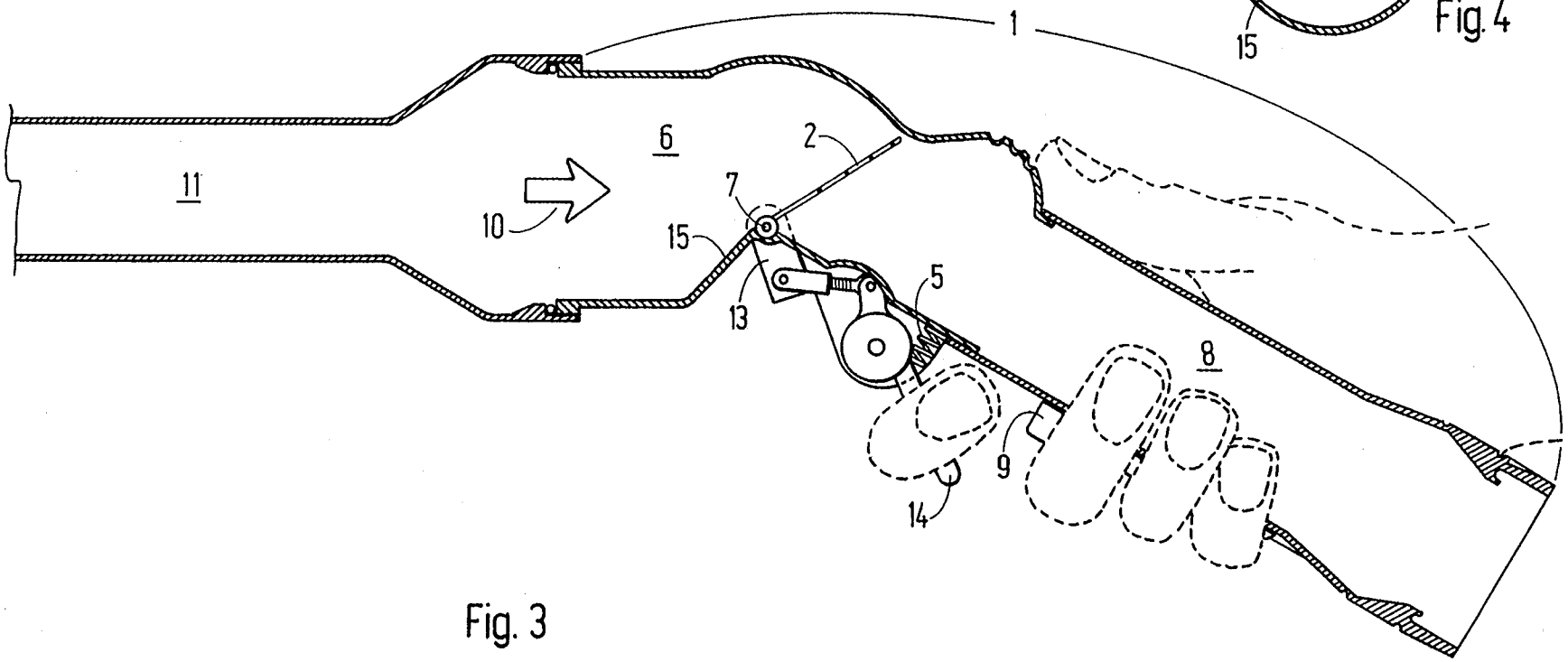
FIG. 3 is a longitudinal section of the culling device of FIG. 1 wherein the culling comb is in a raised position and the actuating mechanism's assembly is seen, with a hand which holds the culling device's handle and has the forefinger on the mechanism's control lever.

The uni-functional culling device (1) illustrated in FIG. 3 shown the culling comb (2) is in a raised position and the actuating mechanism's assembly is clearly seen, with a hand which holds the culling device's handle (8) and has the forefinger on the control lever (14), the other fingers holding over the control lever's slip-lock (9). The direction of the air flow into the culling device is indicated by an arrow (10). One can see, as a part of the actuating mechanism's assembling, that its curved clasp (13) is fixed to the adjustable connection (24) and the axle end (7), where the axle lies on top of the transverse wall (15) inside the culling device.

Figure 4:
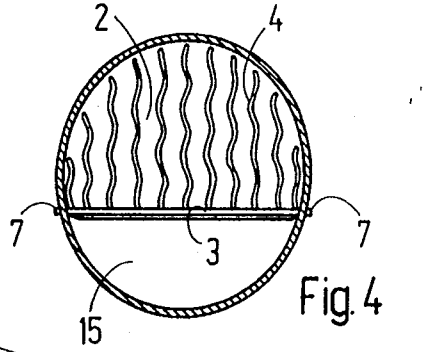
FIG. 4 is a cross section of a portion of the uni-functional culling device of FIG. 1 wherein the culling comb's axle with waveformed parallel teeth is seen in raised position, above the transverse wall at the bottom of the air path.

The culling comb 2 is depicted in detail in the cross of FIG. 4 section of the uni-functional culling device. The axle (8) is seen therein with the waveformed paralell teeth (4) of the culling comb (2) in a raised position on top of the transverse wall (15), which gives support to the culling comb's function, at the bottom of the air path.

Figure 5:
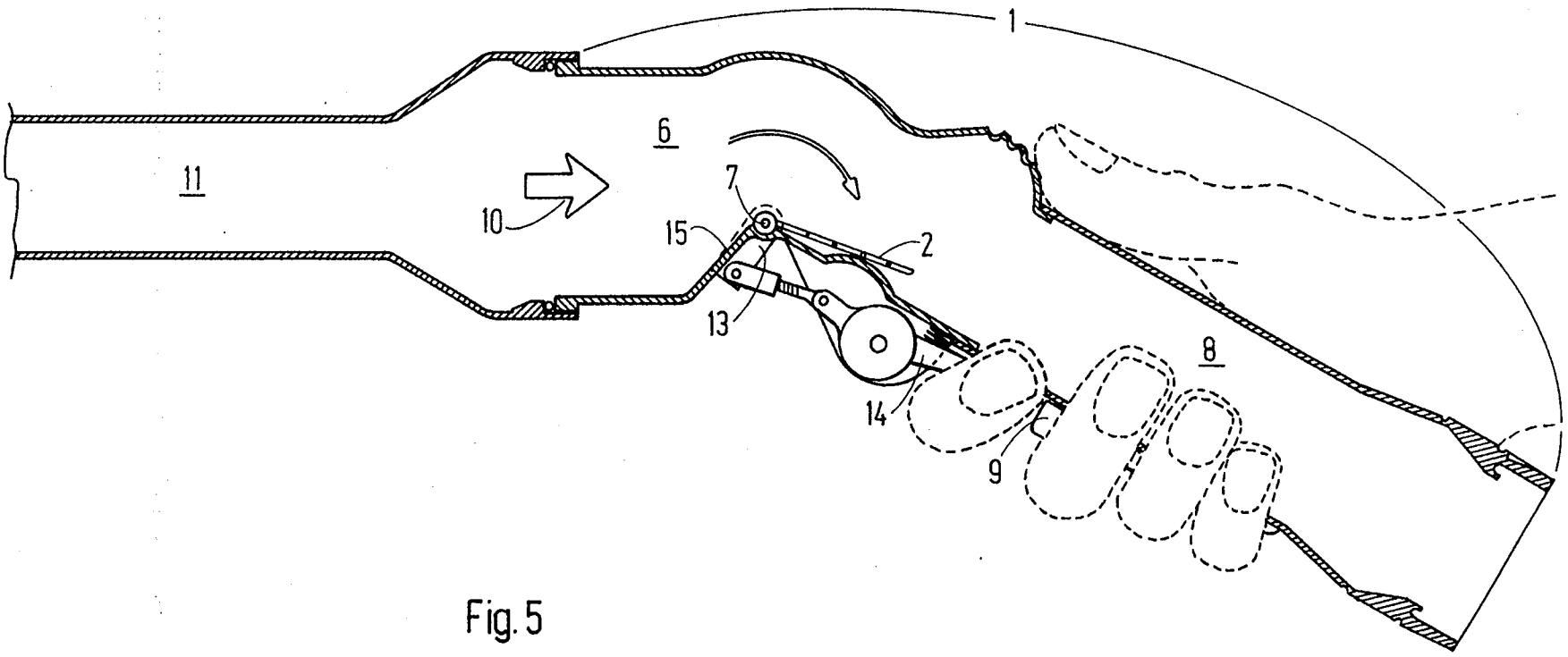
FIG. 5 is a longitudinal section of the culling device of FIG. 1, like that of FIG. 3 except that the culling comb has been laid down by means of the control lever of the actuating mechanism, which the forefinger has pulled up against the culling device's handle.

As shown in FIG. 5 culling comb (2) has been laid down by means of the control lever (14), which the forefinger has pulled up against the culling device's handle (8), thus pushing the clasp (13) by means of the adjustable connection (24), in such way that it turns the axle (7) and laying the culling comb down.

Figure 6:
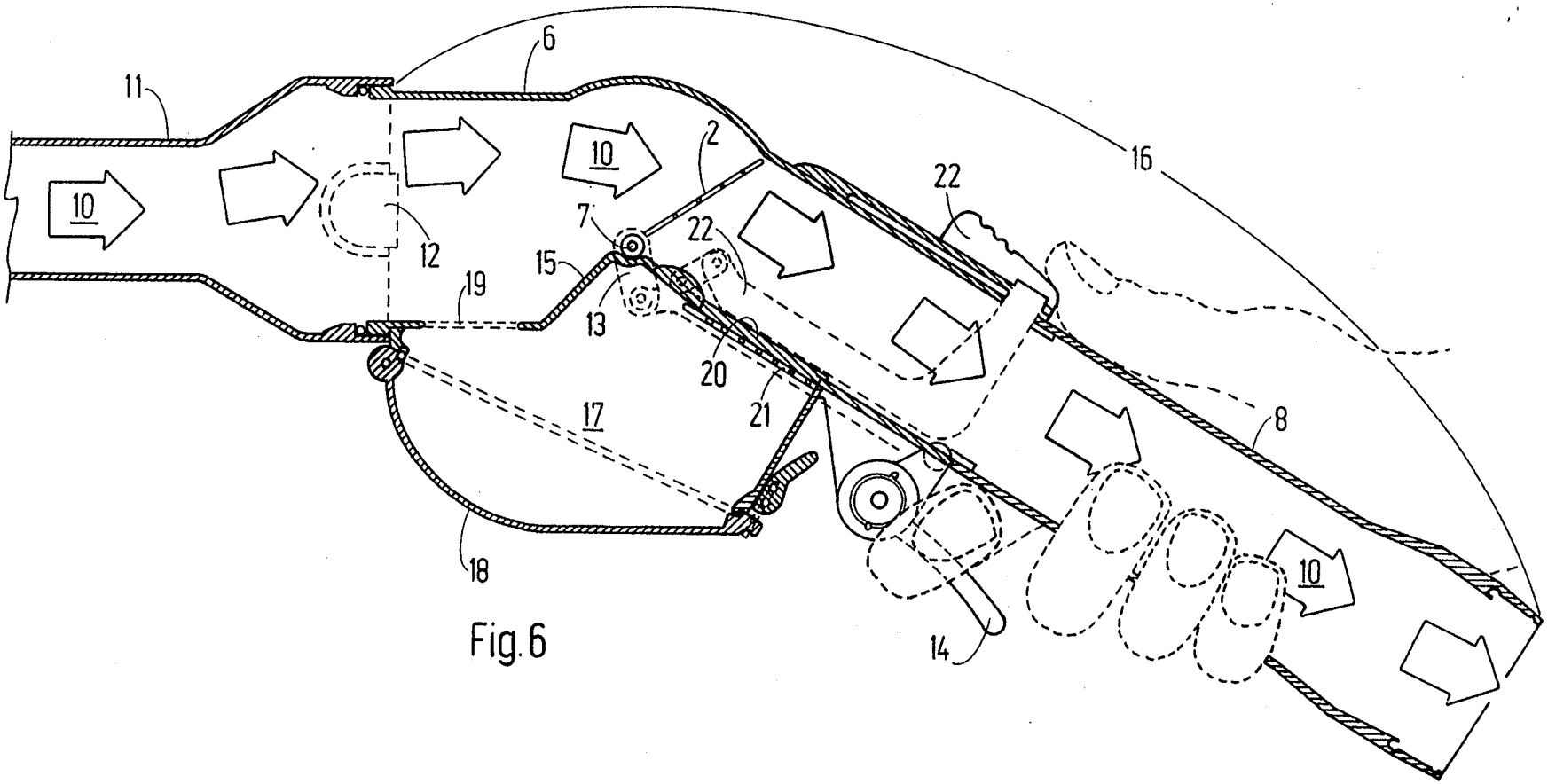
FIG. 6 is a two-functional culling device according to a second embodiment of the invention with the device being shown in longitudinal section. The culling comb is in a raised position and the ordinary path of the air flow through the culling device is shown by broad arrows. A special collecting compartment with an opening and its covering lid is seen under the culling comb.
Figure 7:
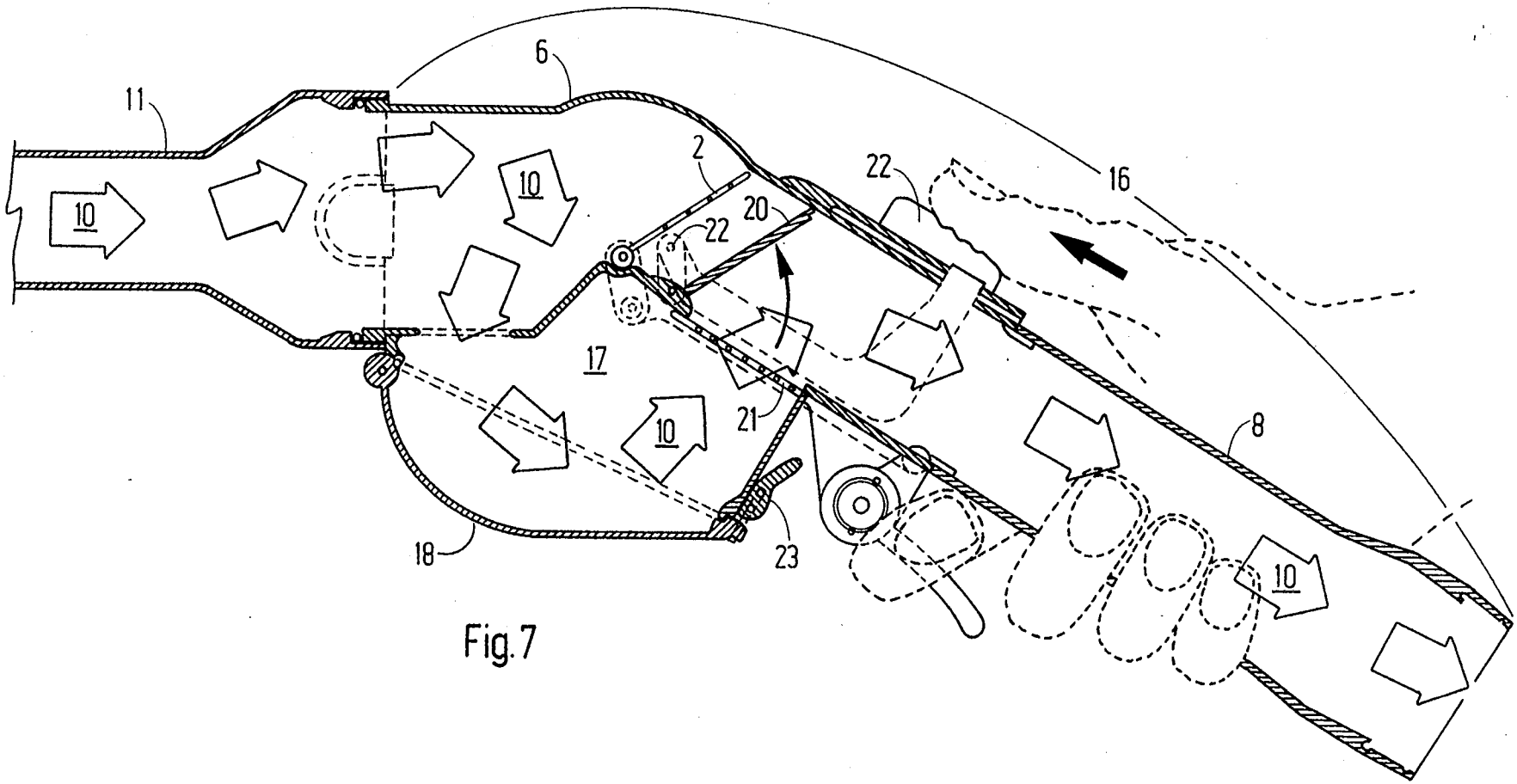
FIG. 7 is a longitudinal section of the device of FIG. 6 wherein the path of the air flow has been directed through the collecting compartment. A flap inside the culling device through the obstructing the ordinary path of the air flow. Beneath the flap a new route is open for the air flow, i.e. up from the collecting compartment, through a hole with a grid at the rear part of the compartment's ceiling. The obstruction flap is operated by its own actuating mechanism which is shown, as a thumb pushes its control knob on the top of the culling device's handle.

A two-functional culling device (16) according to a second embodiment is shown in longitudinal section is in FIG. 6. The culling comb (2) in the device is in a raised position. The ordinary path of the air flow through the culling device is shown by broad arrows (10). A special collecting compartment (17) with a lid (18) covering an opening is seen beneath the culling comb. Articles which have been arrested by the culling comb can be sucked down through a hole (19) into the collecting compartment as shown in FIG. 7. A flap (20) which is operated by its own actuating mechanism (22) lies down and closes an air passage which has a grid (21) and is in the rear part of the compartment's ceiling.

In the two-functional culling device (16) illustrated in the longitudinal section of FIG. 7, the path of the air flow (10) has been altered and directed through the collecting compartment (17) in order to collect into it articles which have been arrested by the culling comb (2). This has been done by raising the flap (20) to obstruct the ordinary path of the air flow, simultaneously opening a new route for it, up from the rear part of the collecting compartment, through a grid (21) which prevents collected articles from proceeding into the vacuum cleaner due to the suction. The flap is operated by its own actuating mechanism, shown as a thumb pushes its control knob (22) on top of the culling device's handle (8). The collecting compartment (17) may be emptied by releasing the snap-lock (23) and opening the lid (18) of the hatch in the bottom at the compartment.

I claim:

1. A culling device for a vacuum cleaner, said culling device comprising means defining a duct extending through the device through which air can pass, a culling comb inside said duct, said culling comb comprising a movable axle with waveformed parallel teeth, and an actuating mechanism for selectively moving the culling comb between a first position where said teeth of the comb extend across the duct inside the culling device for arresting articles which are carried into it, and a second position which permits the articles to pass through said duct, wherein said actuating mechanism includes means for biasing said actuating mechanism for holding said culling comb in said first position when said actuating mechanism is not actuated.

2. A culling device according to claim 1, further comprising a collecting compartment in communication with said duct for collecting articles which have been arrested by the culling comb.

3. A culling device according to claim 2, further comprising means for selectively bypassing the flow of air in said duct around said comb and through said collecting compartment to pull articles arrested by said comb into said collecting compartment.

4. A culling device according to claim 3, wherein said means for selectively bypassing includes a first passage for communicating the duct in the vicinity of the culling comb with an upstream portion of the collecting compartment, a flap and a flap actuating mechanism for selectively moving the flap between a first position where the flap closes a second passage communicating a downstream part of the collecting compartment with said duct downstream of said culling comb while not obstructing the duct, and a second position where the flap obstructs the duct to prevent flow of air through said comb while opening said second passage between the downstream part of the collecting compartment and said duct whereby the air flow in said duct is bypassed around the culling comb and is directed via said first passage into and through said collecting compartment and returned to said duct downstream of the culling comb via said second passage, and said collecting compartment including means for collecting articles which are carried into

5. A culling device according to claim 4, wherein said means for collecting articles in said collecting compartment includes a grid across said second passage which permits air to flow therethrough but which prevents articles from proceeding with the air.

6. A culling device according to claim 2, wherein said collecting compartment has a lid which can be opened to remove collected articles from said compartment.

7. A culling device according to claim 1, wherein said culling device includes a transparent portion through which said duct extends, said culling comb being located in said transparent portion whereby the comb can be seen when in said first position.

8. A culling device according to claim 1, wherein said device includes means for connecting said device to suction pipes of a vacuum cleaner.

9. A culling device according to claim 1, wherein said actuating mechanism includes a control lever outside of said device by which said mechanism can be manually actuated.

10. A culling device according to claim 1, further comprising a slip-lock for maintaining the culling comb in said second position.

* * * * *